United States Patent [19]

Cooper et al.

[11] Patent Number: 4,921,437

[45] Date of Patent: May 1, 1990

[54] SEALED ELECTRICAL CONNECTOR ASSEMBLY WITH TERMINAL RETAINER

[75] Inventors: Ralph M. Cooper, Clemmons; Dana Hollingsworth, Kernersville; John P. Kunkle, Clemmons; Donald G. Stillie, Winston-Salem, all of N.C.

[73] Assignee: AMP Incorporated, Harrisburg, Pa.

[21] Appl. No.: 331,418

[22] Filed: Mar. 29, 1989

[51] Int. Cl.[5] ..... H01R 13/422

[52] U.S. Cl. ..... 439/275; 439/559; 439/595

[58] Field of Search ..... 439/271–277, 439/595, 596, 599, 603, 733, 752, 559

[56] References Cited

U.S. PATENT DOCUMENTS

| | | | |
|---|---|---|---|
| 3,501,736 | 3/1970 | Norris | 339/91 |
| 3,601,760 | 8/1971 | Cairns | 339/59 |
| 4,319,799 | 3/1982 | Pearce, Jr. | 339/217 R |
| 4,343,523 | 8/1982 | Cairns et al. | 339/59 M |
| 4,557,542 | 12/1985 | Coller et al. | 339/59 M |
| 4,621,883 | 11/1986 | Noguchi | 339/60 M |
| 4,679,885 | 7/1987 | Nestor et al. | 439/752 |
| 4,711,508 | 12/1987 | Sueyoshi | 439/595 |
| 4,711,509 | 12/1987 | Cross et al. | 439/595 |
| 4,722,704 | 2/1988 | VanDerStuyf et al. | 439/851 |
| 4,752,251 | 6/1988 | Kato et al. | 439/752 |
| 4,767,350 | 8/1988 | Cooper et al. | 439/271 |
| 4,767,361 | 8/1988 | Hoshino et al. | 439/596 |
| 4,776,813 | 10/1988 | Wilson et al. | 439/587 |
| 4,820,198 | 4/1989 | Lulko et al. | 439/595 |
| 4,864,190 | 8/1989 | Clark et al. | 439/587 |

FOREIGN PATENT DOCUMENTS 2081526 7/1981 United Kingdom .

*Primary Examiner*—Neil Abrams
*Attorney, Agent, or Firm*—Robert W. Pitts

[57] ABSTRACT

A sealed electrical connector assembly comprising an insert molded header, a sealed connector plug matable in an exterior header cavity and an unsealed connector plug matable in an interior header cavity is disclosed. Each connector plug incorporates a secondary lock and terminal position assurance. An outer housing cover forming a portion of the mating envelope at the forward end of the connector plugs can be secured to the forward section of the insulative housing only when a resilient latch, forming a primary latch, is in a fully seated position. If the latch is in the deflected or not fully seated position, an abutting ledge on the housing cover will engage the deflected latch to prevent assembly of the housing cover to the insulative housing.

25 Claims, 7 Drawing Sheets

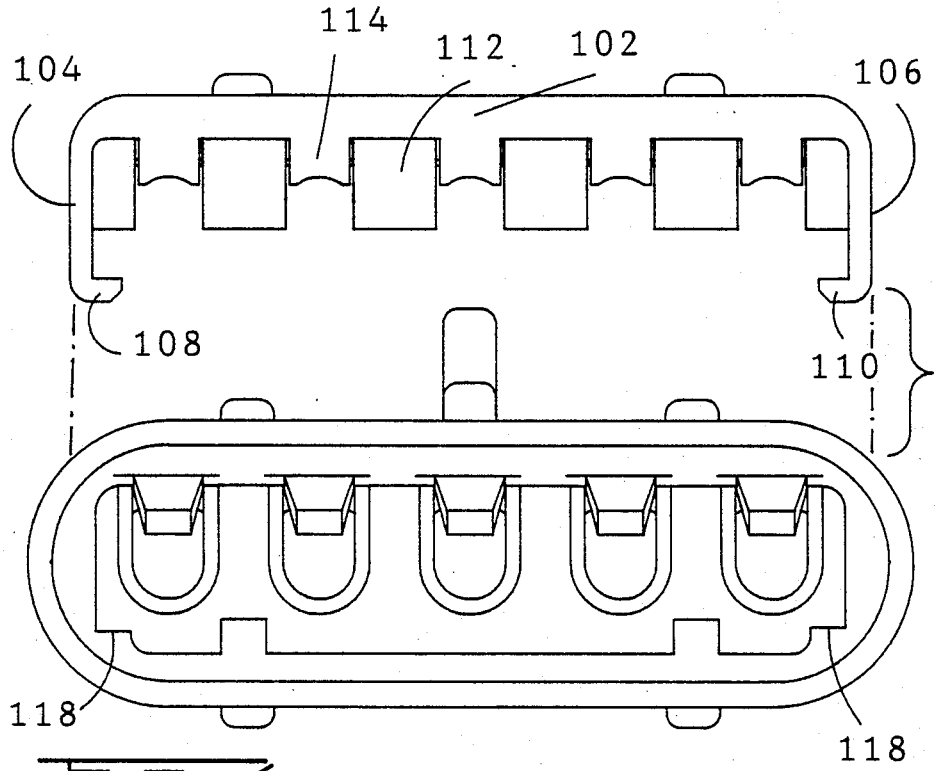
Fig. 6
Fig. 7
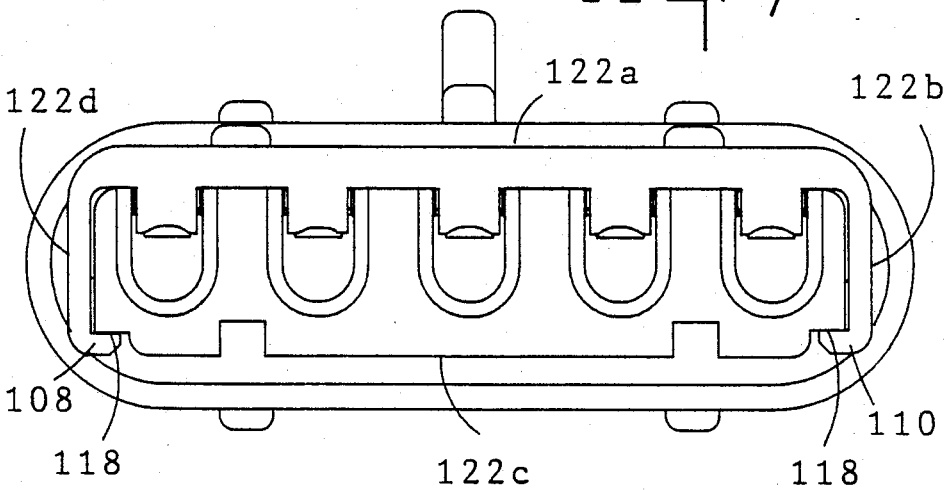

SEALED ELECTRICAL CONNECTOR ASSEMBLY WITH TERMINAL RETAINER

BACKGROUND OF THE INVENTION

1. Field of the Invention

This invention is directed to a sealed electrical connector assembly for use in interconnecting a plurality of wires on opposite sides of a bulkhead or wall and more specifically is related to a sealed electrical connector assembly consisting of two multicontact electrical connectors and an immediate header located in a wall or bulkhead of a tank such as a fuel tank in an automobile.

2. Description of the Prior Art

Conventional electrical connectors used for automotive applications typically employ both a secondary lock and terminal position assurance features. A secondary lock comprises a separate locking member which is secured to an insulative housing to insure that electrical terminals are properly retained in the insulative housing of the electrical connector. Secondary locks are commonly used in conjunction with resilient latches which form an integral portion of the insulative body. Typically, electrical terminals are crimped to conductors, such as insulated wires and then inserted into an insulative housing. These conductors deflect resilient housing latches during insertion. Upon complete insertion the latch is then free to return toward its initial position and lock the terminals in place. In addition to providing a primary locking system using a resilient housing latch to engage the terminals, most automotive connectors also employ a secondary lock which is assembled to the insulative housing after insertion of the terminal. This secondary lock acts independently of the resilient housing latch to prevent inadvertent withdrawal of the terminal from the housing.

In addition to employing secondary locking members, most automotive connectors also include terminal position assurance features which prevent engagement of a secondary lock when the terminals are improperly positioned within the housing. For example, a secondary lock without terminal position assurance features could be attached to a housing before the terminal is fully inserted and is positioned where the secondary lock will not engage the terminal and where the resilient latch will not engage the terminal.

Two types of secondary locking members are commonly used on automotive connectors. U.S. Pat. No. 3,501,736 discloses an electrical connector in which a secondary locking member, which can engage recesses on terminals, is inserted from one side of the housing to lock the housing in place. Another common locking member is disclosed in U.S. Pat. No. 4,557,542 which discloses the use of a separately insertable wedge member which is received behind the integral latch arms and prevents these latch arms from being deflected out of engagement with a corresponding terminal. If the integral latch arms used in that type of locking system are deflected, the separate wedge member cannot be inserted.

Although many conventional automotive electrical connectors are used in applications where sealing is unnecessary, there are a large number of applications in which sealing integrity must be established not only around the wires but also at the interfacial surface where the connectors mate. Conventional connectors such as that shown in U.S. Pat. No. 4,767,350 employ family seals comprising a single elastomeric member with a plurality of holes. These seals establish a sealing intergrity with the wires extending through the holes. Sealing at the interface of the connector can be established by use of a gasket type seal such as that shown in U.S. Pat. No. 4,767,350 or by the use of a discrete O-ring or peripheral seal. Although the addition of seals to an electrical connector increases the complexity of the connector, secondary locking and terminal position assurance remain desirable features of sealed as well as unsealed connectors.

SUMMARY OF THE INVENTION

The instant invention is directed to a sealed electrical connector assembly employing an electrical connector having a plurality of electrically conductive terminals positioned within an insulative housing. In the preferred embodiment of this invention, this electrical connector comprises a sealed electrical connector plug insertable into a mating electrical connector. Each terminal is retained within the insulative housing by a resilient latch engaging the terminal when both the latch and the terminal are in a fully seated position. The resilient latch is outwardly deflectable from a fully seated position. The insulative housing employed in this electrical connector has one exposed surface. The resilient latch is exposed along this exposed housing. A housing cover or secondary lock can be secured to the insulative housing to enclose the exposed surface. This housing cover or secondary lock has an inner profile which in the preferred embodiment of this invention comprises a plurality of ledges, abutting any resilient latch which remains outwardly deflected and which is not in the fully seated position. The housing cover or secondary lock is not engagable with the insulative housing unless all of the resilient latches are in a fully seated position. The preferred embodiment of the housing cover or secondary lock also includes a plurality of projections which separately engage the terminals to secure them in the insulative housing. The cover also stabilizes the contact in housing.

This electrical connector is matable with a header which includes a receptacle cavity into which the connector is inserted. In the preferred embodiment of this invention the housing cover or secondary lock is attached to the mating end of the connector such that the mating end of the insulative housing with the housing cover attached, forms a mating profile or envelope which can be inserted into a close fitting receptacle cavity in the header. If the housing cover is not fully secured to the insulative housing at the mating end, the assembled connector cannot be inserted into the receptacle cavity of the mating header connector. An interfacial seal can be established by positioning a discrete peripheral seal around the exterior of the insulative housing between the rear end and the mating end on which the cover is positioned. In this position the peripheral seal will protrude radially beyond the assembled housing-housing cover mating envelope.

In the preferred embodiment of this invention this connector can be used in a sealed and unsealed configuration and can be mated in one of two cavities in an integral header assembly of the type which can be inserted into a hole in a wall or bulkhead. The header includes a plurality of pin terminals which in the preferred embodiment are insert molded into the header. In the embodiment depicted herein the header can be in the form of a right angle connector. A peripheral seal around the header establishes sealing integrity between the header and the wall. A sealed connector having a discrete peripheral seal and a family seal surrounding the conductors can then be inserted into a receptacle cavity on the header on the exterior of the wall. Thus, all potential leak paths can be sealed. A connector in accordance with the preferred embodiment of this invention can therefore be used as a sealed connector assembly for a tank such as a fuel tank in an automobile.

BRIEF DESCRIPTION OF THE DRAWINGS

FIG. 3 is a plan view, partially in section, showing the positioning of electrical terminals in an insulative housing and showing an exposed surface of the electrical plug connector prior to assembly of a housing cover or secondary lock.

FIG. 6 is an in-view of the insulative housing with the housing cover exploded.

FIG. 8 is an end-view of the header showing the cavity on the exterior of a fuel tank into which a sealed connector can be inserted.

FIG. 9 is a view of the header assembly showing the receptacle cavity in which an unsealed connector, located on the interior of the fuel tank wall would be positioned within the header cavity.

DETAILED DESCRIPTION OF THE PREFERRED EMBODIMENT

Figures 1, 1A, 1B:
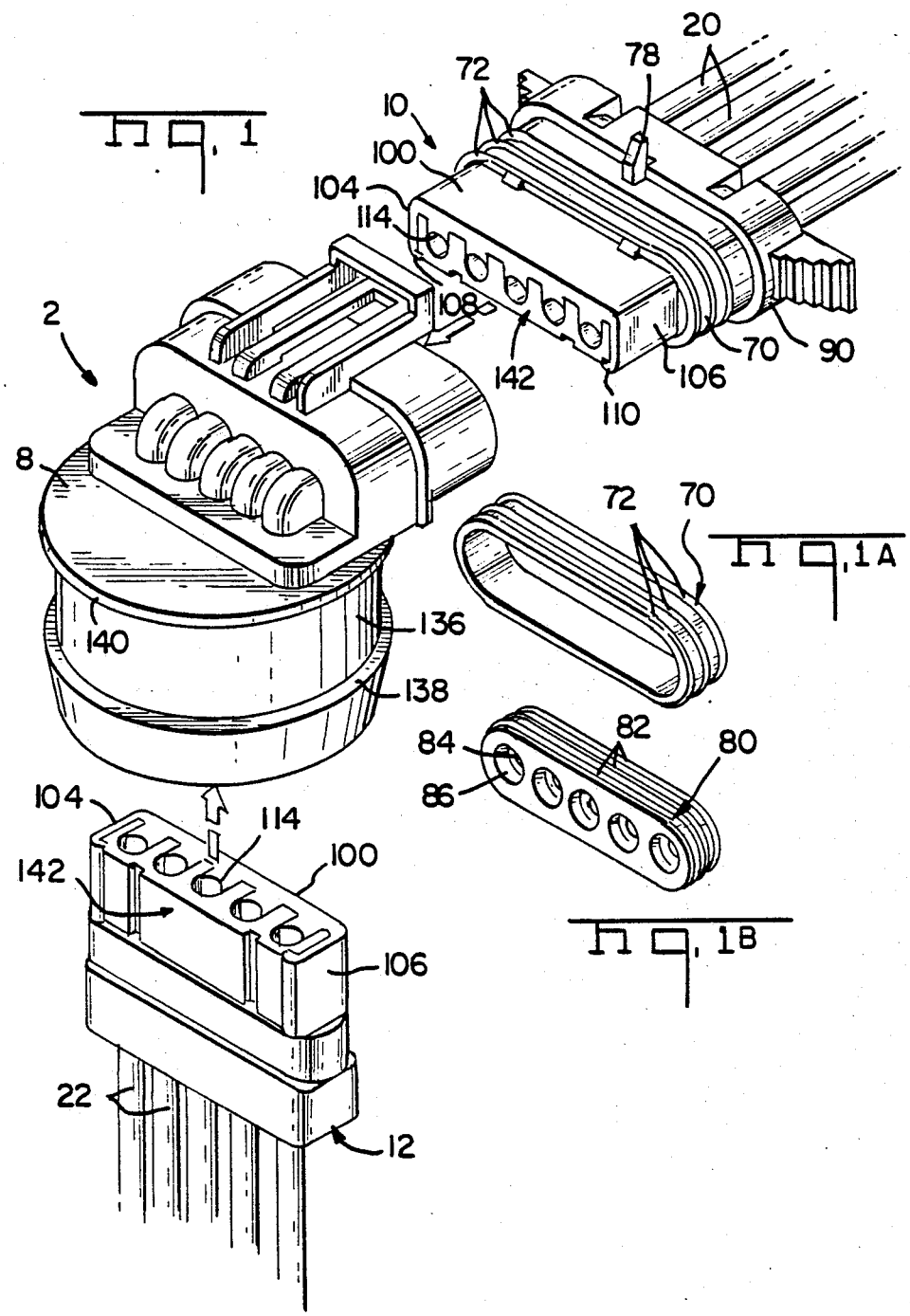
FIG. 1 is an exploded perspective view showing the elements of the sealed connector assembly. Individual seals are shown in FIGS. 1A and 1B.

The sealed electrical connector assembly 2 comprising the preferred embodiment of this invention is adapted for use in a bulkhead or wall 4. In the preferred embodiment of this invention this sealed electrical connector assembly is especially adapted for use in a fuel tank to provide an interconnection between a wiring harness and an electrical fuel level sensor and pump mounted within the interior wall of a fuel tank. A sealing grommet 6 provides the sealing integrity between a header 8 positioned within a hole in the bulkhead or wall 4. Header 8 comprises a right angle header having two receptacle cavities. A sealed electrical connector plug 10 can be inserted into the receptacle cavity on the exterior of the bulkhead or wall 4. A similar unsealed connector plug 12 can be inserted into the header cavity located within the sealed environment of the fuel tank. Sealed connector plug 10 and unsealed connector 12 thus provide electrical connectors mateable with a mating connector in the form of the header 8. Solid pins 14 are positioned within the header 8 and terminals 16 and 18 located within connector plugs 10 and 12 respectively form the electrical interconnection between the component located within the tank and the external harness. Terminals 16 are crimped to external wires or conductors 20 whereas terminals 18, otherwise identical to terminals 16 are crimped to internal wires or conductors 22.

The terminals 16 and 18 used in the sealed connector plug 10 and the unsealed connector plug 12 comprise otherwise identical socket or receptacle type electrical terminals having a cylindrical pin receptacle 24 located at the mating end of each terminal. Each connector plug has a plurality of terminals. In the preferred embodiment of this invention five electrically conductive electrical terminals are positioned within each connector plug to establish an electrical interconnection with pins 14. Each of the terminals 16 and 18 comprises a stamped and formed terminal. The cylindrical receptacle 24 located at the mating end of each terminal is circular in cross-section and is in the form of a barrel. A slot can be located intermediate the ends of the barrel to make the barrel more compliant. A wire crimp 26 of conventional configuration suitable for use on stripped wires is located intermediate the ends of each terminal 16, 18. A support barrel 25 is located between the cylindrical receptacle 24 and wire crimp secton 26. Support barrel 25 has a smaller outside dimension than the cylindrical receptacle 24. An insulation crimp 28, providing strain relief to the crimped interconnection, is positioned at the rear of each terminal 16, 18. In the preferred embodiment of this invention a wire crimp 26, suitable for use with stranded wires, is employed. Each cylindrical pin receptacle has a pair of contact embossments. Upper contact embossment 30 on each terminal is formed by depressions located on opposite side of the shear line or contact slit 38. Lower contact embossment 32, is positioned on the opposite side of the cylindrical pin receptacle section. The cylindrical pin receptacle extends between an inner receptacle end 34 and outer receptacle or barrel end 36 located at the free end of the terminal. A shoulder is formed at the inner receptacle end 34. This shoulder provides a stop surface against which a latch can engage. Since the terminals 16, must be inserted through holes in a conductor seal member, no protruding contact lances are formed on the terminal. The terminals 16, 18 can be stamped and formed from a conventional electrically conductive metal such as a brass alloy. A phosphor bronze, such as a copper alloy 511 as designated by the Copper Development Association, Inc. could be used.

The insulative housing 40 of the sealed connector plug 10 and the unsealed connector plug 12 comprises a one piece plastic member molded out of conventional insulative material such as an acetal resin such as Delrin 500T. Delrin is a trademark of DuPont de Nemours Co. The same insulative housing 40 can be employed for both the sealed connector plug 10 or the unsealed connector plug 12. Alternatively, an insulative housing having a different keying or polarizing configuration can be employed to insure that the unsealed connector plug 12 is not mistaken for the sealed connector plug 10 or mismatched to the header. Insulative housing 40 has a forward section 42, an intermediate section 44 and a rear section 46. In the preferred embodiment of this invention, the forward section 42 adjacent the mating end 56 is exposed along one surface. Open channels 48 formed by a plurality of upstanding barriers 54 are open on this exposed surface of the forward section 42. These channels are in alignment with and communicate with cylindrical chambers 50 extending through the intermediate section of the housing. The cylindrical chambers 50 in turn communicate with an open or common pocket 52 which is exposed at the rear end of the insulative housing 40. The upstanding barriers 54 which define channels 48 extend upwardly from the lower wall of the forward section 42 of the insulative house 40. These same barriers 54 extend rearwardly from the mating end 56 of the forward section. A plurality of recesses or slots is formed in the upstanding barriers 54. These recesses or slots 58 are located in alignment intermediate the ends of the forward section 42. The lower floor of each open channel 48 includes a ramped surface 96 which slopes upwardly toward the mating end of the housing and terminates in a tooth or collar 98 located opposite an integral latch 60.

Figure 4:
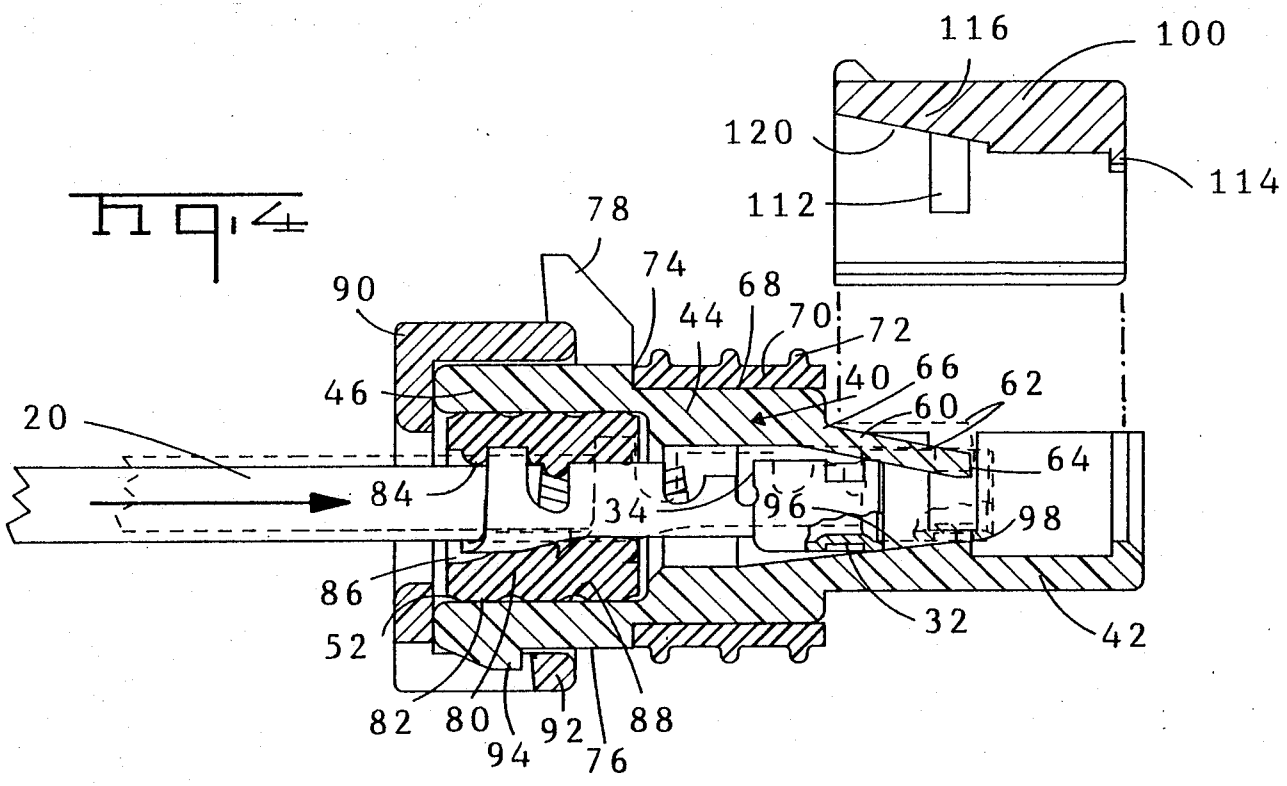
FIG. 4 is a cross-section showing a partially inserted terminal in an insulative housing and depicting the deflection of integral resilient latches. A cross-sectional view of an exploded housing cover or secondary lock is also shown within FIG. 4.
Figure 5:
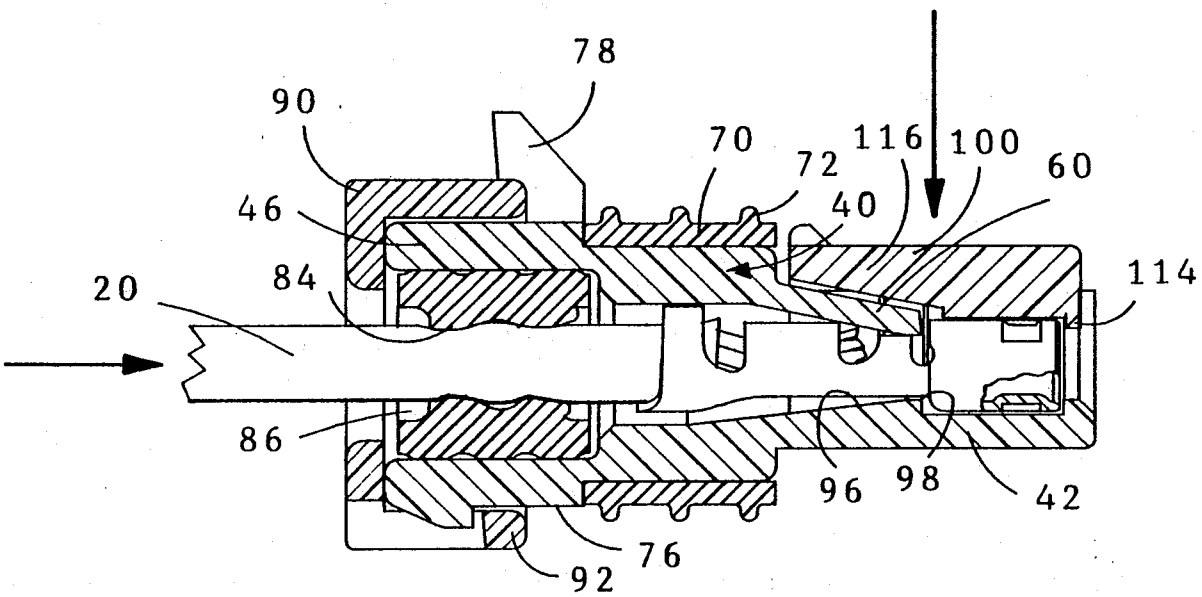
FIG. 5 is a view similar to FIG. 4 showing the assembly of a housing cover to the insulative housing with a crimped terminal in the fully seated position.

Integral resilient latches 60 extend from the intermediate section of the housing along the exposed surface of the forward section 42. These resilient latches 60 extend between barriers 54 and the free end 64 of each resilient latch 60 is located substantially in alignment with the recesses or slots 58 which are located beside the resilient latches 60. The upper surface 62 of each resilient latch 60 slopes downwardly toward the lower wall of the forward section from the base 66 of the resilient arm, where it is joined to the intermediate section 44 of the housing, to the free end 64 located in the vicinity of recesses 58. The upper surface 62 of the resilient latch slopes toward the floor or lower wall of the forward section 42 when the resilient latch is in its fully seated position as shown in FIG. 5. As shown in FIG. 4, each resilient latch 60 comprises a cantilever beam which can be outwardly deflected from its fully seated position. Outward deflection of resilient latch 60 is shown by the dashed lines in FIG. 4. FIG. 4 shows that as the terminal is inserted further into the forward section 42 of the housing, the resilient latch 60 will be deflected outwardly. With terminal 16 in the fully seated position, as shown in FIG. 5, the resilient latch 60 can return to its fully seated position. The resilient latches 60 engage each terminal to urge the terminal against a tooth 98 at the end of the ramping surface 96 on the floor of the forward section 42 of the housing and thus comprises means for securing the terminals with their cylindrical pin sections 24 in the channels 48. Note that the free end 64 of the resilient latch 60 engages the inner receptacle end 34. Tooth or collar 98 engages the other side of the inner receptacle end 34. Although the resilient latch is outwardly deflectable to permit the insertion of the terminals into the housing, the resilient latch resists deflection by a rearward force applied to the terminal because the inner receptacle end 34, engages the free end 64 of the resilient latch and will not tend to cam or deflect the resilient latch 60 outwardly from its fully seated position as shown in FIG. 5. The resilient latch pushes downward against the support barrel which wedges and pushes the contact downward against the lower tooth 98.

An intermediate peripheral sealing surface 68 is formed on the exterior of the intermediate section 44 of the insulative housing. A peripheral seal or oval seal 70 is positioned on this peripheral sealing surface 68. Peripheral seal 70 has a plurality of sealing ribs 72 on its external surface. An external stop 74 is formed at the rear of the peripheral sealing surface where the intermediate section joins the rear section 46. A rear external surface or shroud, of which the external stop 74 forms the forward end defines the outer periphery of the rear section 46. An upstanding hook member 78 is located on one surface of the rear section 46. This hook member 78 is located on the same side of the insulative housing 40 as the exposed surface of the forward section 42, in the preferred embodiment of this invention.

A wire seal 80 in the form of a family seal having a plurality of holes 86 through which a crimped terminal can be inserted forms a seal between the insulative housing 40 and individual wires 20. External sealing ribs 82 are formed on the wire seal 80. These sealing ribs 82 engage in pocket sealing surface 88 on the interior of the shroud 46. Both the peripheral seal 70 and the wire seal 80 are formed from conventional elastomeric materials. The wire seal 80 is formed from a material which will not be destroyed when the terminals are inserted through holes 86. Ribs 82 and 84 on the exterior and the interior of the seal, establish sealing integrity in a conventional manner. A seal retainer 90 having a flexible latch shoulder 92 engagable with a stationary latch shoulder 94 on the shroud 46 is provided to secure the seal 80 in place within the pocket 52.

Figure 7:
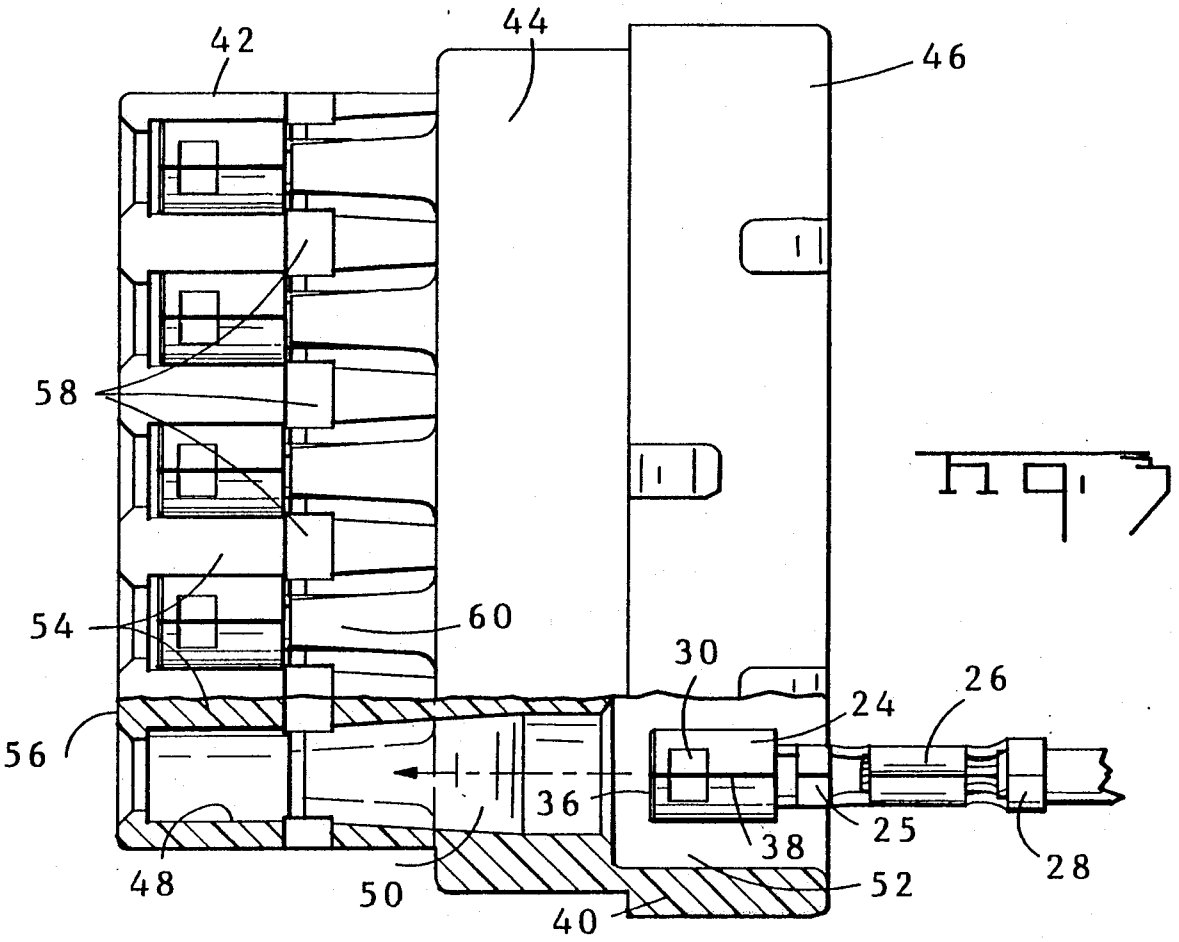
FIG. 7 is an end-view similar to FIG. 6 showing the housing cover fully assembled to the insulative housing.

The secondary lock or housing cover 100 is configured to be attachable to the forward section 42 of the housing 40. This secondary lock or cover 100 has an upper wall 102 from which opposite sidewalls or endwalls 104 and 106 depend. Locking shoulders 108, 110 are formed at the lower free ends of the sidewalls and endwalls 104, 106. A plurality of projections 112 extend from the inner surface of the upper wall 102. Adjacent projections 112 are spaced apart by a distance greater than the width of support barrel 25 but less than the diameter of the cylindrical receptacle 24. Projections 112 thus act as a secondary lock to prevent terminal extraction and also provide terminal position assurance since they can only be inserted if the terminals are fully inserted. Lead in surfaces 114 are formed at the free end of the secondary lock 100. A plurality of ledges 116, extending between projections 112, are also located on the inner surface of the upper wall 102. The lower surface 120 of each ledge 116 slopes downwardly towards the front end of the housing cover 100. This sloping surface 120 is inclined at an angle generally the same as the slope of the upper surface 62 of the resilient latches 60. The secondary lock or housing cover 100 is engagable or matable with the forward section 42 of the insulative housing only when the resilient latches 60 are in their fully seated position as shown in FIG. 5. Housing cover 100 comprises an external locking member with the projections 112 being dimensioned for receipt within the recesses 58. Ledges 116 are then positioned in alignment with the resilient latches 60 which extend above the channels 48. The housing cover 100 comprises a secondary locking member which encloses the exposed surface of the forward section 42 of the insulative housing 40 only when the inner profile, in the form of ledges 116 does not abut a deflected resilient latch 60. Only when the resilient latches 60 are in their fully seated position can the housing cover 100 to be secured to the insulative housing by engagement of locking shoulders 108 and 110 at the lower ends of sidewalls 104 and 106 with grooves 118 on the lower edges of the mating end of the forward section 42. As shown in FIG. 7, a mating envelope is formed when the housing cover 100 is secured to the forward section 42 of housing 40. This mating envelope has sides 122A, 122B, 122C and 122D, with the envelope side 122A corresponding to the initially exposed surface of the forward section 42 of insulative housing 40. The housing cover 100 is formed from conventional insulative material. It should be noted, however, that although the housing cover 100 can be formed from any number of materials, it must be formed from a material which will allow the endwalls 104 and 106 to deflect during insertion on to the forward section 42 of the insulative housing 40. The peripheral seal 70 located on the intermediate section of the housing, protrudes beyond each of the mating envelope sides 122A through D.

As previously mentioned, the unsealed connector plug 12 is substantially the same as the sealed connector plug 10, although a different mating profile may be adopted for these connectors so that the unsealed connector plug 12 cannot be inadvertently substituted for the sealed connector plug. Both the sealed connection plug 10 and the unsealed connector plug 12 are matable with the header 8. Header 8 is formed from an insulative member defining a header body 130. This header body 130 can be molded from a conventional thermoplastic material. A first mating cavity 132 is formed along the top of the header body 130. A second cavity 134 is formed along the lower portion of header body 130. A peripheral sealing surface 136 extends around the header body 130 intermediate its upper and lower ends. This sealing surface 136 extends between lower lip 138 and upper lip 140. The sealing surface 136 is dimensioned for engagement with the sealing grommet 6 which forms the seal between the header 8 and the bulkhead 4 when the sealing grommet 6 is positioned within an opening in the bulkhead 4 along which sealing integrity is to be established. First and second cavities 132 and 134 extend only partially into the header body from spaced ends thereof. A plurality of solid pins 14 extend through the header body between the first and second cavities. In the preferred embodiment of this invention the header 8 comprises a right angle header, and pins 14 have a right angle configuration. This right angle header is formed by insert molding pins 14 within the header body 130. Not only does this insert molding provide a simple method of positioning the right angle pins 14 within the header body, but by insert molding the pins within the header body a seal is formed around each pin 14.

A circumferential groove 160 is formed around each pin on an exterior surface of the header body 130. By forming this circumferential groove 160, the tendency of the plastic material to change its shape and pull away or recede from the pins 14 is diminished. Molding this groove 160 as shown helps ensure that a seal will be maintained around each pin by the insert molded header body 130.

Figure 2:
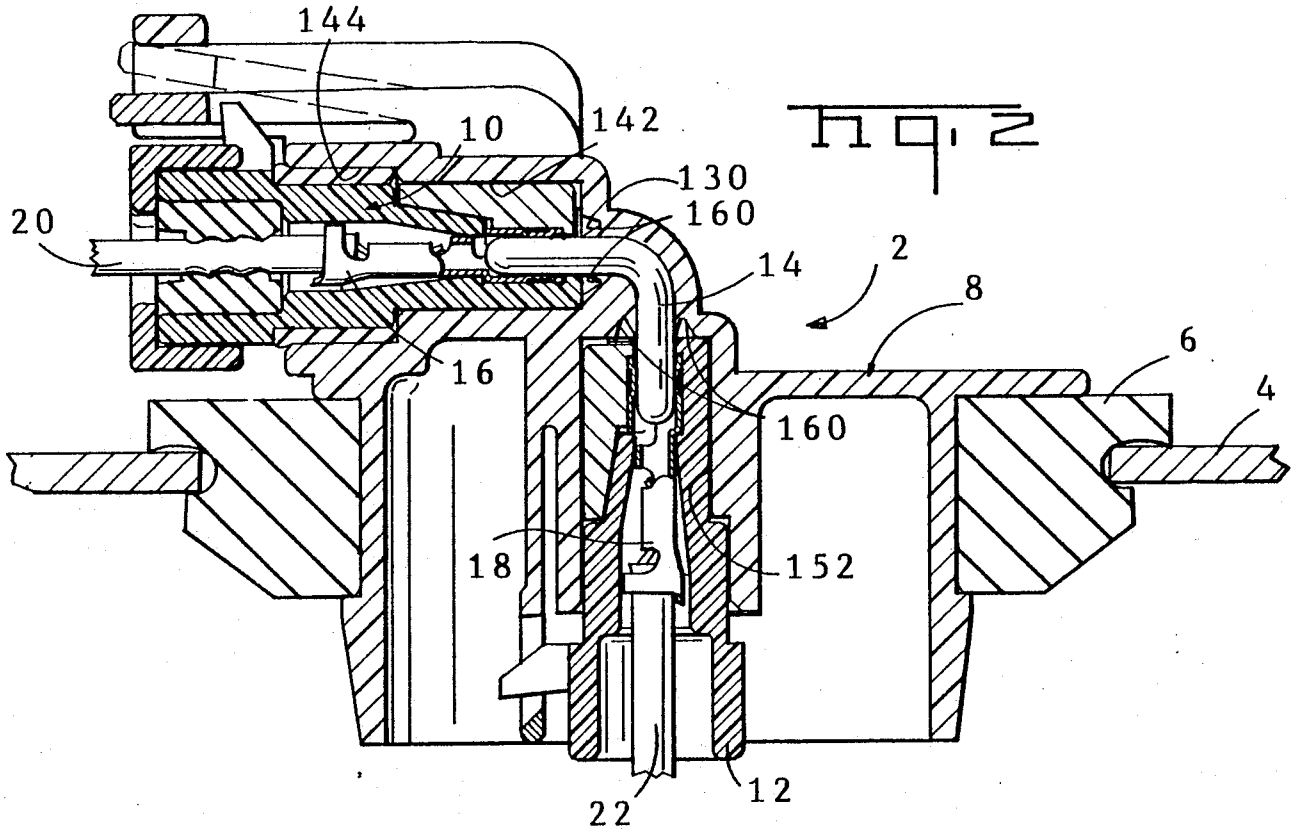
FIG. 2 is a section view through an assembled connector assembly showing the positioning of the connector assembly in a bulkhead such as the wall of a fuel tank.

The exterior wall of the header body 130 conforms to the right angle bend section of the pin, resulting in a substantially constant wall thickness, thus simplifying insert molding. As can be seen in FIG. 2, the right angle configuration provides a relatively low profile along the upper surface of the bulkhead or wall 4. The first cavity 132 has a stepped inner surface including a forward mating section which conforms generally to the shape of the mating envelope formed by the mated forward section 42 and housing cover 100. A close fit is provided between the mating contour 142 and the mating envelope 122 so that the sealed connector 10 can be inserted into the mating contour 142 only when the housing cover 100 is fully seated on the forward section 42 of the insulative housing 40. An oval sealing surface 144, which conforms generally to the exterior surface of the peripheral seal 70 is located at the open end of the cavity 132. Thus the connector can be inserted into the first cavity and a seal can be established along surface 144 when the housing cover 100 is fully assembled to insulative housing 40 providing both a secondary locking mechanism and terminal position assurance means. If the terminals are not fully seated within the insulative housing, the sealed connector plug 10 cannot be assembled to the header 8. Resilient clip 148 extending above the first cavity 132 is engageable with the hook 78 on the sealed connector plug 10 to retain the plug 10 within the cavity 132. The second cavity 134 is located adjacent a second clip 150 so that an unsealed connector plug 12, also having a fully assembled housing cover 100 attached thereto can be inserted into the second cavity 134 with the mating envelope 122 conforming to the inner contour 152 of the second cavity.

The sealed electrical connector assembly 2 is assembled by first crimping terminal 16 and 18 to strip wires 20 and 22 in a conventional manner. Crimped terminals 16 and 18 can then be inserted into the insulative housing 40 of connector plugs 10 and 12. The peripheral seal 70 would normally be preassembled to the exterior surface of the insulative housing 40 and the wire seal 80 will have been placed within pocket 52. Cover 90 will have been placed onto housing rear section 46 to retain the seal. Crimped terminals 16 and 18 can be inserted through holes 86 in the seal 80. These holes 86 are in alignment with enclosed cylindrical chambers which extend through the intermediate section of the housing 40. These chambers 50 are also in alignment with channels 48. During insertion of the terminals 16, 18 through the chambers 50 and into the channels 48, the resilient latch 60 is deflected as depicted in FIG. 4. The terminals can be pushed axially forward until they abut contact stops extending upwardly from the front of the housing. When the terminals 16, 18 are fully inserted, the cylindrical receptacle 24 of each terminal 16, 18 will be located within the channels 48. With the terminal in this fully seated position, the resilient latch 60 can return to its fully seated position with its free end 64 in engagement with the inner receptacle end 34. The resilient latch 60 urges the terminal down against the tooth on the floor of the forward section 42 so that the free end of the receptacle 24 will abut a shoulder on the lower end of the forward section to prevent the terminal from being pushed through the insulative housing 40. With the terminal positioned in this manner, the housing cover 100 can be attached to the forward section 42 of the housing 40. The projections 112 extending from the inner surface of the housing cover 100 are wide enough such that when the projections 112 are fitted within recesses 58, these projections 112 will be located behind the inner receptacle end 34 and will provide a secondary locking feature in addition to the resilient latches 60. These projections 112 will also abut the cylindrical receptacle portions 24 of the terminals 16, 18 if the terminals are not fully seated. Since the lower surface 120 of the ledges 116 slopes at generally the same angle as the upper surface 62 of the resilient latch 60, when the resilient latch is in its fully seated position, the surface 120 will be substantially flush with surface 62. If the resilient latch 60 is deflected out of its fully seated position, this sloping ledge surface 120 will abut the resilient latch before the latching shoulders 108 and 110 at the free end of the endwalls 104, 106 engage the grooves 118 located along the lower end of the forward section 42. The endwalls 104, 106 will then be deflected outwardly and in general the upper wall 102 would extend above the mating envelope formed by 122A through D. With the housing cover protruding beyond the mating envelope 122, the connector cannot be inserted within the corresponding mating cavities 132 or 134 in the header 8, thus the connector plugs 10 and 12 cannot be attached to the header 8 unless each of the multiple terminals 16, 18 in the plugs 10, 12 are in their fully seated position with both a primary lock and a secondary lock being established. In this manner, this sealed connector assembly can incorporate terminal position assurance features.

We claim:

1. An electrical connector having a plurality of electrically conductive terminals disposed within chambers in an insulative housing, each terminal being retained within a respective chamber by a resilient latch engaging the terminal in a fully seated position, the resilient latch being outwardly deflectable from the fully seated position, the connector being characterized in that a portion of each chamber comprises a channel exposed on one external side of the housing, the resilient latch being exposed on the one external side of the housing, the connector further including a housing cover engagable with the housing to enclose the otherwise exposed channel, the housing cover having an inner profile abuttable with the resilient latch when the resilient latch is outwardly deflected from the fully seated position, so that the housing cover is engagable with the housing only when the resilient latch is in the fully seated position.

2. The electrical connector of claim 1 wherein the resilient latch comprises an integral extension of the insulative housing.

3. The electrical connector of claim 2 wherein the upper surface of the resilient latch slopes inwardly toward its free end.

4. The electrical connector of claim 3 wherein the inner profile of the housing cover includes at least one sloping ledge inclined at the same angle as the upper surface of the resilient latch when the resilient latch is in the fully seated position.

5. The electrical connector of claim 4 wherein the housing cover includes sidewalls having locking shoulders on the ends thereof engagable within grooves on the insulative housing, the sidewalls being deflectable.

6. The electrical connector of claim 5 wherein the housing cover includes a plurality of projections located between adjacent ledges, the projections being positioned between adjacent terminals when the housing cover is attached to the insulative housing.

7. The electrical connector of claim 5 wherein each terminal includes a cylindrical pin receptacle, the corresponding resilient latch engaging the rear of the cylindrical pin receptacle in the fully seated position.

8. The electrical connector of claim 7 wherein the insulative housing includes an open channel as part of each chamber, each open channel being dimensioned to receive a cylindrical pin receptacle.

9. The electrical connector of claim 8 wherein each resilient latch is engagable with a corresponding terminal to urge the terminal against a floor of the corresponding channel.

10. The electrical connector of claim 9 wherein the floor of each channel comprises a ramping surface leading to a tooth engaging the rear of the cylindrical pin receptacle for each fully inserted terminal.

11. A sealed electrical connector plug insertable along its longitudinal axis into a mating electrical connector, the sealed electrical connector plug comprising:

a plurality of electrical terminals having conductors attached thereto;

an insulative housing having a forward section in which the terminals are located and which is contained within a mating envelope having four sides, an intermediate section protruding beyond the envelope containing the forward section, and a rear section;

an external seal surrounding the intermediate section, an external surface of the external seal protruding radially outward beyond the mating envelope around the entire periphery thereof;

conductor sealing means located within the rear section and surrounding the conductors:

the electrical connector plug being characterized in that the forward section is open on one side of the envelope, a one-piece external locking member being attachable to the forward section to secure the electrical terminals in the housing, the external locking member enclosing the forward section on the one open side thereof with the external seal protruding beyond the external locking member.

12. The sealed electrical connector plug of claim 11 wherein the forward section comprises a lower wall having a plurality of upstanding barriers forming channels open to the open side of the envelope.

13. The sealed electrical connector plug of claim 12 wherein the external locking member comprises a member having an upper wall with two end walls depending from ends of the upper wall, the two end walls having locking means for securing the external locking member to the forward section of the insulative housing.

14. The sealed electrical connector plug of claim 13 wherein the external locking member comprises a cover enclosing open portions of the channels.

15. The sealed electrical connector plug of claim 14 wherein the insulative housing includes a plurality of cylindrical chambers extending through the intermediate section in alignment with the channels.

16. The sealed electrical connector plug of claim 15 wherein the insulative housing includes a plurality of outwardly deflectable resilient latches aligned with the cylindrical chambers and extending above the channels, the resilient latches comprising means for securing the terminals in the cylindrical chambers and the channels.

17. The sealed electrical connector plug of claim 16 wherein the upper wall of the external locking member has an inner profile abuttable with resilient latches when fully seated so that the external locking member is matable with the forward section only when the resilient latches are not outwardly deflected.

18. The sealed electrical connector plug of claim 17 wherein each resilient latch slopes downwardly toward the lower wall in an undeflected position in which the terminals are secured in the channels and cylindrical chambers by the resilient latches, the external locking member having a plurality of depending ledges which abut any corresponding resilient latches remaining in a deflected position so that the external locking member can be secured to the forward section of the insulative housing only when all resilient latches are in an undeflected position holding corresponding terminals in the channels and cylindrical chambers.

19. The sealed electrical connector plug of claim 18 wherein the external locking member includes a plurality of projections aligned with and insertable into recesses between resilient latches in the housing, each projection abutting a terminal when the terminal is not in a fully seated position.

20. The sealed electrical connector plug of claim 19 wherein the rear section has a common internal pocket, each cylindrical chamber extending from the pocket into the intermediate section of the housing, the conductor sealing means comprising an elastomeric member insertable within the pocket, the elastomeric member having holes communicating with corresponding cylindrical chambers when the elastomeric member is in the pocket.

21. The sealed electrical connector plug of claim 20 wherein an external step is formed between the intermediate section and the rear section, the external seal abutting the external step when the external seal is positioned in surrounding relationship to the intermediate section.

22. A sealed electrical connector assembly insertable in a sealing grommet positioned within an opening in a bulkhead, the sealed electrical connector assembly comprising:

a header insertable in the grommet so that the grommet forms a seal between the header and the bulkhead, the header comprising an insulative body having first and second cavities extending partially into the header from spaced ends thereof, and a plurality of pins extending from the first cavity through the header body into the second cavity;

a first electrical connector plug having a plurality of first receptacle terminals positioned within a first insulative housing and a first secondary lock member forming a cover on a portion of a mating end of the first insulative housing, the first secondary lock being securable to the first insulative housing to define a mating envelope conforming to the contour of the first cavity only when the first receptacle terminals are in a fully inserted position in the first insulative housing so that the first electrical connector plug can be inserted into the first cavity only when all of the first receptacle terminals are in a fully seated position; and a second electrical connector plug having a plurality of second receptacle terminals positioned within a second insulative housing and a second secondary lock member forming a cover on a portion of a mating end of the second insulative housing, the second secondary lock being securable to the second insulative housing to define a second envelope conforming to the contour of the second cavity only when the second receptacle terminals are in a fully inserted position in the second insulative housing so that the second electrical connector plug can be inserted into the second cavity only when all of the second receptacle terminals are in a fully seated position.

23. The sealed electrical connector assembly of claim 22 further comprising a peripheral seal surrounding at least one insulative housing to form a seal within the corresponding cavity, each electrical connector plug having wire sealing means for establishing sealing integrity with wires attached to the receptacle terminals therein.

24. The sealed electrical connector assembly of claim 23 wherein the pins are insert molded into the header.

25. The sealed electrical connector assembly of claim 24 wherein the header comprises an right angle header.

* * * * *